US010830486B2

(12) United States Patent
Harris et al.

(10) Patent No.: US 10,830,486 B2
(45) Date of Patent: Nov. 10, 2020

(54) AIR HANDLING UNIT AND METHOD FOR CONTROLLING A FLOW OF AIR THERETHROUGH

(71) Applicant: MESTEK, INC., Westfield, MA (US)

(72) Inventors: Daniel Harris, Stoughton, MA (US); Nicholas Searle, Summing, GA (US)

(73) Assignee: MESTEK, INC., Westfield, MA (US)

( * ) Notice: Subject to any disclaimer, the term of this patent is extended or adjusted under 35 U.S.C. 154(b) by 506 days.

(21) Appl. No.: 15/010,026

(22) Filed: Jan. 29, 2016

(65) Prior Publication Data

US 2016/0223221 A1 Aug. 4, 2016

Related U.S. Application Data

(60) Provisional application No. 62/109,709, filed on Jan. 30, 2015, provisional application No. 62/137,930, filed on Mar. 25, 2015.

(51) Int. Cl.
*F24F 13/10* (2006.01)
*F24F 3/044* (2006.01)
*F24F 11/74* (2018.01)

(52) U.S. Cl.
CPC ..... *F24F 13/10* (2013.01); *F24F 3/0442* (2013.01); *F24F 11/745* (2018.01)

(58) Field of Classification Search
CPC ..... F24F 11/043; F24F 11/745; F24F 3/0442; F24F 13/10
USPC ..... 454/255
See application file for complete search history.

(56) References Cited

U.S. PATENT DOCUMENTS 1,850,069 A * 3/1932 Beatty ..... F28D 1/024 126/285 R
3,114,505 A * 12/1963 Kennedy ..... F24F 3/056 236/13
3,611,908 A * 10/1971 Spoormaker ..... F24F 1/01 137/890
3,650,318 A * 3/1972 Avery ..... F24F 3/0442 165/103
3,946,647 A * 3/1976 Larkfeldt ..... F24F 1/01 454/263
4,017,025 A * 4/1977 Dravnieks ..... F24F 3/0442 236/49.4
4,031,951 A * 6/1977 Engler ..... F24F 1/01 137/601.12
4,090,434 A * 5/1978 Krisko ..... F24F 13/26 454/264
4,508,022 A * 4/1985 Finkelstein ..... F24F 1/01 454/299

(Continued)

*Primary Examiner* — Edelmira Bosques
*Assistant Examiner* — Dana K Tighe
(74) *Attorney, Agent, or Firm* — Grogan, Tuccillo & Vanderleeden, LLP

(57) ABSTRACT

An air handling unit includes a manifold having an inlet configured to receive a supply of air, a plurality of apertures formed in the manifold, the apertures enabling a passage of air from the manifold out of said the handling unit, a bypass plenum formed in the manifold, and a damper positioned within the bypass plenum. The damper is pivotable between a closed position and an open position to allow air from the manifold to exit the air handling unit without passing through the apertures when a pressure within the manifold exceeds a threshold pressure.

4 Claims, 4 Drawing Sheets

(56) References Cited

U.S. PATENT DOCUMENTS 6,427,454 B1 * 8/2002 West ..... F24F 3/153
62/93
9,222,687 B2 * 12/2015 Petrovic ..... F24F 1/0007

* cited by examiner

AIR HANDLING UNIT AND METHOD FOR CONTROLLING A FLOW OF AIR THERETHROUGH

CROSS-REFERENCE TO RELATED APPLICATIONS

This application claims the benefit of U.S. Provisional Application Ser. No. 62/109,709, filed on Jan. 30, 2015, and U.S. Provisional Application Ser. No. 62/137,930, filed on Mar. 25, 2015, both of which are herein incorporated by reference in their entireties.

FIELD OF THE INVENTION

The present invention relates generally to chilled beam apparatuses and, more particularly, to an active chilled beam or ceiling induction unit apparatus having an integrated barometric air damper for increasing the operational metrics of the active chilled beam apparatus.

BACKGROUND OF THE INVENTION

Chilled beam apparatuses are well known in the art, and are utilized to efficiently condition the air within a confined space. Known chilled beam apparatuses can be passive in nature, relying upon only the natural air convection of a space to instigate the heat transfer within the active chilled beam apparatus. Or, in active chilled beam apparatuses, a blower unit can be utilized in addition to the natural convection currents of a space to promote the passage of air through the heat exchanging portion of the chilled beam unit.

Known active chilled beam apparatuses effect the conditioning of the air within a space in accordance with the parameters of the chilled beam unit, including such considerations as the volume and pressure of the blower, the size of the unit itself and the nature of the heat transferring pipes and liquid therein. Known chilled beam apparatuses, however, are unable to pass additional blower air into the conditioned space without the air passing through the induction nozzles in the chilled beam apparatus. The additional air may be required to satisfy increased ventilation requirements.

There therefore exists a need within the industry for the ability to increase the blower airflow to the active chilled beam apparatus, without changing the operation of the apparatus as a whole.

SUMMARY OF THE INVENTION

With the forgoing concerns and needs in mind, it is the general object of the present invention to provide an active chilled beam apparatus.

It is another object of the present invention to provide an active chilled beam apparatus that can increase the rate of blower air while bypassing the induction nozzles of the chilled beam apparatus.

It is another object of the present invention to provide an active chilled beam apparatus that includes an integrated barometric air damper.

It is another object of the present invention that the integrated barometric air damper is actuated as a result of a change in air pressure within the plenum or air manifold of the chilled beam apparatus.

These and other objectives of the present invention, and their preferred embodiments, shall become clear by consideration of the specification, claims and drawings taken as a whole.

According to an embodiment of the present invention, an air handling unit includes a manifold having an inlet configured to receive a supply of air, a plurality of apertures formed in the manifold, the apertures enabling a passage of air from the manifold out of said the handling unit, a bypass plenum formed in the manifold, and a damper positioned within the bypass plenum. The damper is pivotable between a closed position and an open position to allow air from the manifold to exit the air handling unit without passing through the apertures when a pressure within the manifold exceeds a threshold pressure.

According to another embodiment of the present invention, a method for controlling a flow of air in an air handling unit includes the steps of, at a manifold, receiving a supply of air, passing the air from the manifold out of the air handling unit through a plurality of apertures in the manifold and, when a pressure within the manifold exceeds a threshold pressure, opening a damper associated with a bypass plenum to allow the air to exit the manifold without passing through the apertures.

According to yet another embodiment of the present invention, an air handling unit includes a manifold having an inlet configured to receive a supply of air from a blower, a plurality of induction apertures formed in the manifold, the induction apertures enabling a passage of air from the manifold out of the air handling unit and being configured to induce a flow of air from a space below the air handling unit into the air handling unit, a bypass plenum formed in the manifold and configured to selectively direct air from the manifold to the space below the air handling unit without passing through the induction apertures, a damper positioned within the bypass plenum, the damper being pivotable between a closed position and an open position to allow the air from the manifold to exit the air handling unit through the bypass plenum when a pressure within the manifold exceeds a threshold pressure, and an actuator operatively connected to the damper, the actuator being adjustable to set said threshold pressure.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
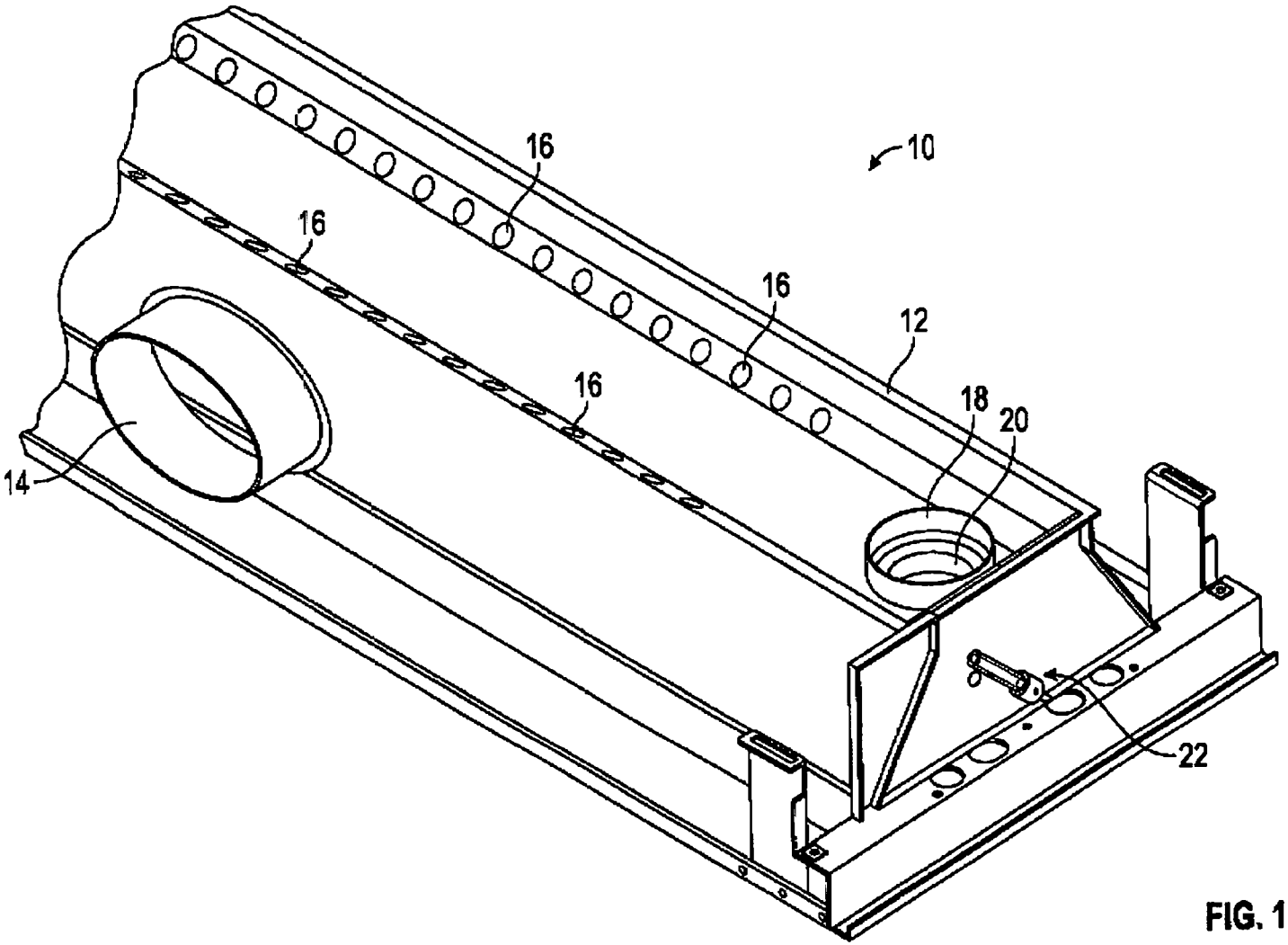
FIG. 1 illustrates an isomeric, open top view of an active chilled beam apparatus, according to one embodiment of the present invention.

FIG. 1 illustrates an isomeric, open top view of an active chilled beam apparatus 10, according to one embodiment of the present invention. As shown in FIG. 1, the chilled beam apparatus 10 includes an upper air manifold 12 that is supplied with a variable flow of input air via an air aperture 14, as connected to a blower assembly (not shown) or the like. As will be appreciated, the top cover of the air manifold 12 has been removed from FIG. 1, in order to expose to view the structure of the chilled beam apparatus 10, however this top cover would be in place during actual operation of the chilled beam apparatus 10.

As is well known, air that is fed into the air manifold 12 via the air aperture 14 and non-illustrated blower is expelled out the bottom of the chilled beam unit 10 via entraining air holes 16, oriented along either longitudinal side of the air manifold 12.

Figure 2:
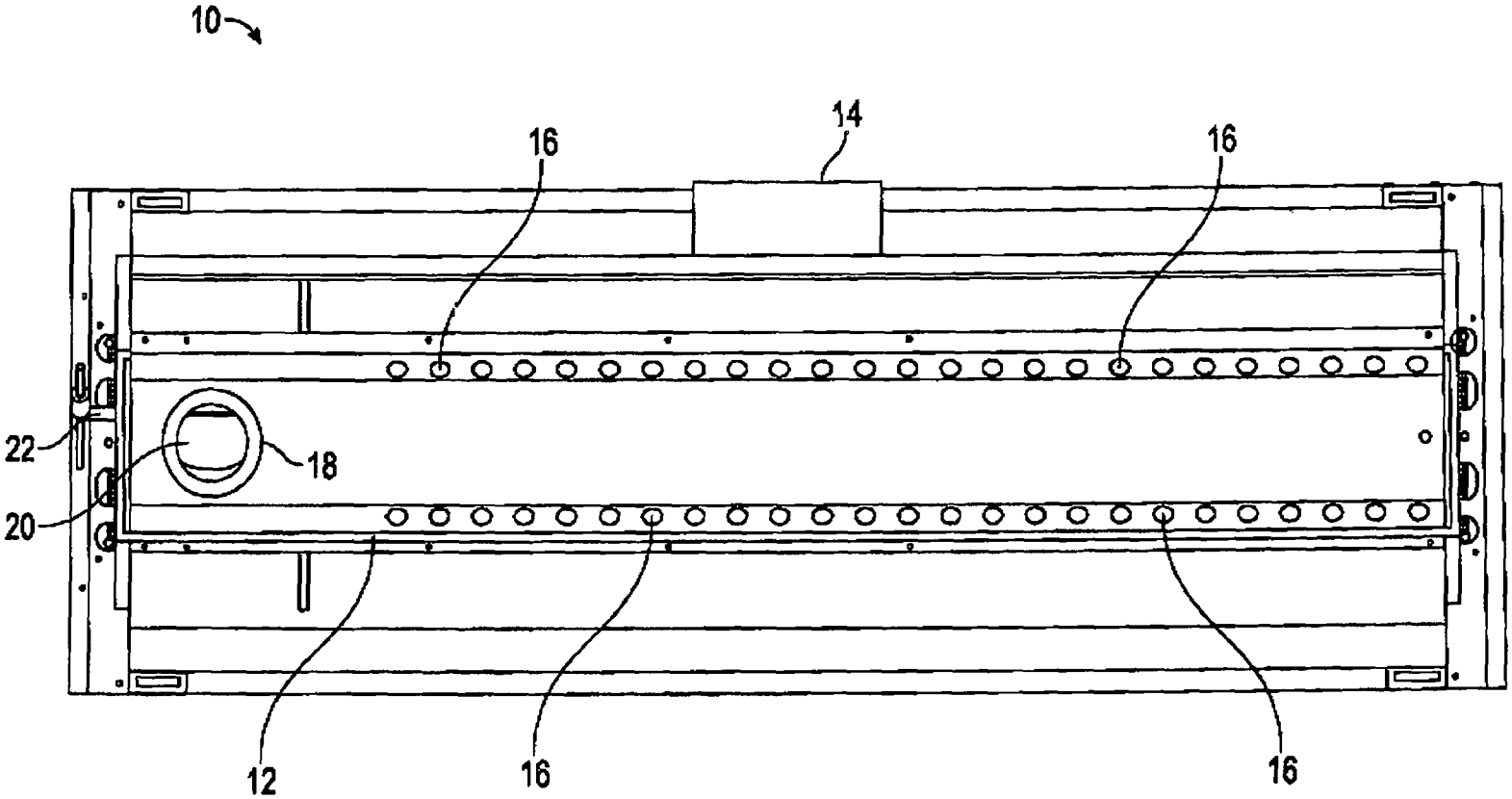
FIG. 2 illustrates a plan, open top view of the chilled beam apparatus 10, shown in FIG. 1.

As also seen in FIG. 1, an air bypass plenum 18 is formed adjacent one distal end of the chilled beam apparatus 10. The air bypass plenum 18 includes an integral and selectively pivotable baffle or air damper 20, which itself is connected to a gravity weighted actuator 22. FIG. 2 illustrates a plan, open top view of the chilled beam apparatus 10, shown in FIG. 1.

Figure 3:
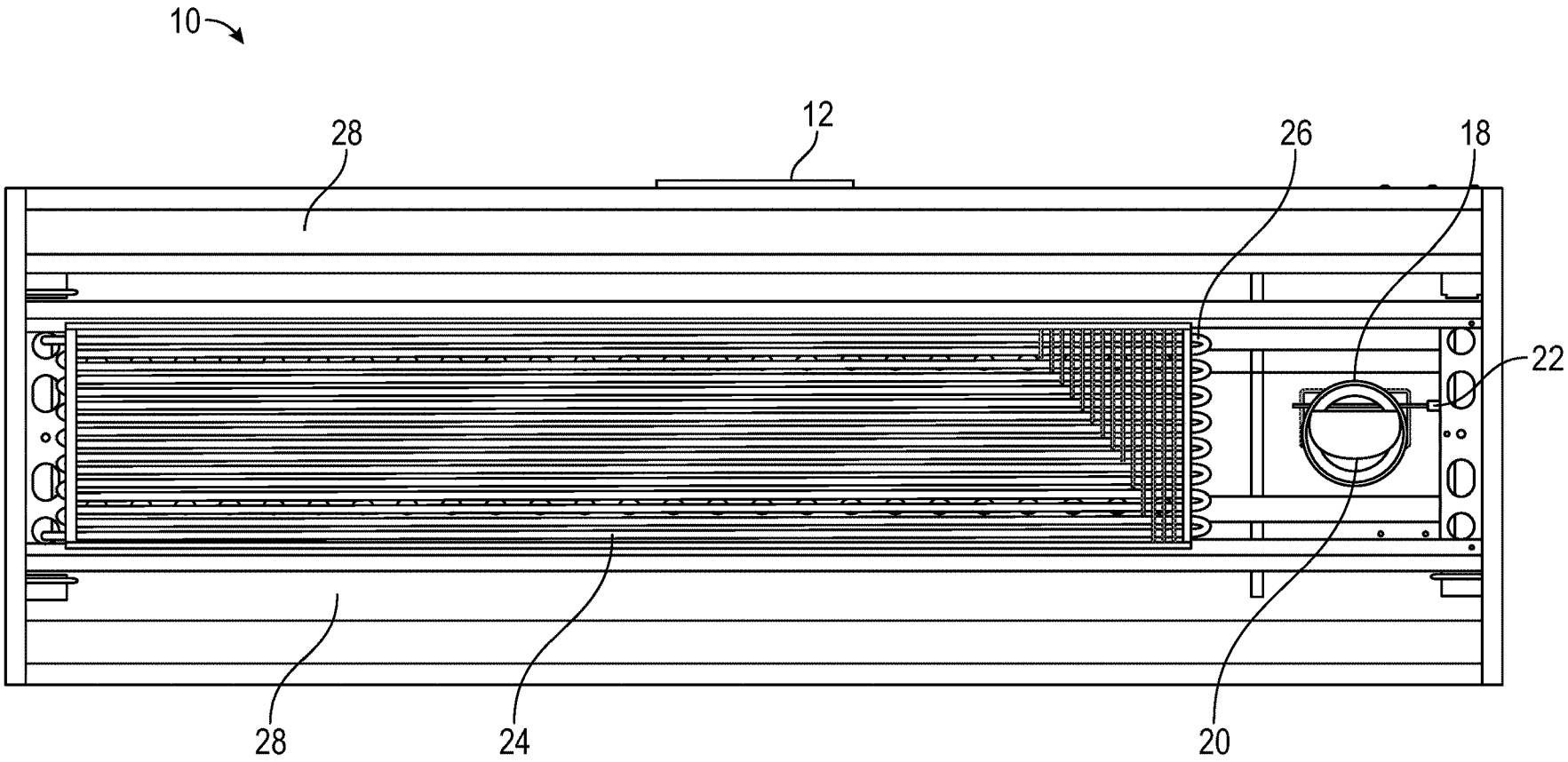
FIG. 3 illustrates a plan, open bottom view of the chilled beam apparatus shown in FIG. 1.

For its part, FIG. 3 illustrates a plan, open bottom view of the chilled beam apparatus 10. As shown in FIG. 3, the central portion of the chilled beam apparatus 10 includes a heat transfer section 24 comprised of one or more windings of conditioning tubes 26. As is also well known, these conditioning tubes 26 contain fluid of variable temperature, and provide the surface area necessary to effectuate heat transfer between induced air passing up and through the heat transfer section 24. The conditioning tubes 26 may be supplied with recirculated conditioning fluid via any number of known fluid conditioning systems, without departing from the broader aspects of the present invention.

FIG. 3 also illustrates entrained air passageways 28, which extend along the longitudinal axis of the chilled beam apparatus 10 and are in fluid communication with the entraining air holes 16. The entrained air passageways 28 provide a pathway of egress to the air that has been conditioned by the heat transfer section 24 of the chilled beam apparatus 10. The air bypass 18, and integrated air damper 20 and weighted actuator 22, are also shown in FIG. 3. It will be readily appreciated that a suitable grating or fin structure (30; shown in more detail in FIG. 4) may cover the heat exchange section 24 and distal portion containing the air damper 20, without departing from the broader aspects of the present invention.

Figure 4:
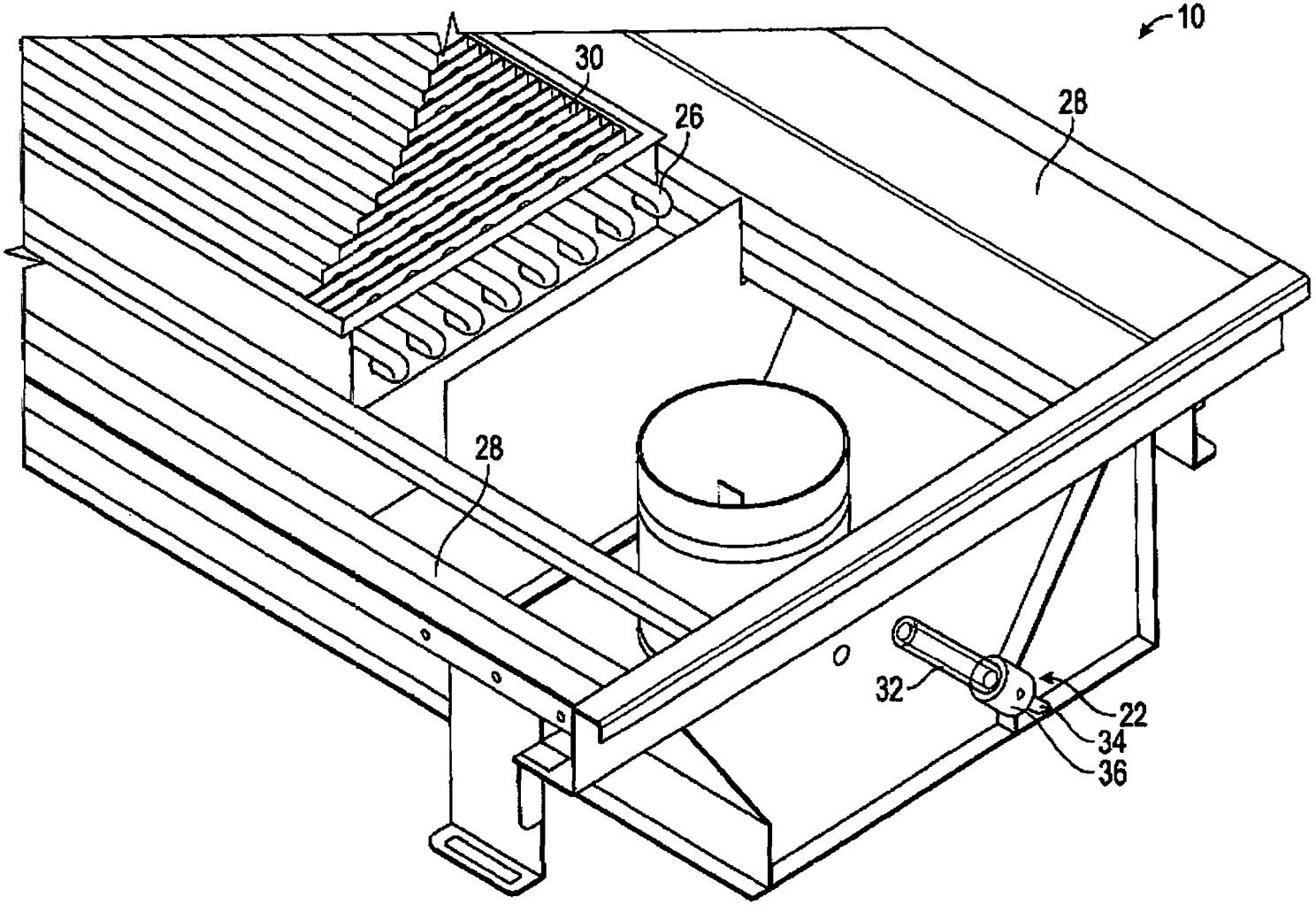
FIG. 4 illustrates an enlarged, isomeric view of the bottom of the chilled beam apparatus shown in FIGS. 1-3.

FIG. 4 illustrates an enlarged, isomeric view of the bottom of the chilled beam apparatus 10 shown in FIGS. 1-3. As shown in FIG. 4, the weighted actuator 22 includes a pivotable center axle 32 that is fixedly connected to the air damper 20, such that rotation of axle 32 causes a resultant rotation of the air damper 20 within the air bypass plenum 18. An adjustment pin and weight, 34 and 36, respectively, are keyed to the central axel 32. The position of the adjustment weight 36 may be selectively shifted and fixed along the length of the adjustment pin 34, in order to cause rotation of the axel 32 and air damper 20 when an appropriate air pressure force is applied to the air damper 20, as will be discussed in more detail later. In an embodiment, various means may be employed to fix the weight 36 in position on the pin 34 such as, for example, a friction fit or a set screw.

In operation, the air manifold 12 of chilled beam apparatus 10 is supplied with air via the aperture 14 and a non-illustrated blower assembly. As the pressure of air within the air manifold 12 is selectively increased, the biasing effect of the weight 36 is overcome, and the air damper 20 will be caused to rotate and open. Once the air damper 20 has opened, the pressurized air within the air manifold 12 will stream out of both the air holes 16, as well as the air plenum 18, and into the space below the chilled beam apparatus 10.

It is therefore an important aspect of the present invention to provide additional ventilating air to the space without the necessity of pushing the air from the blower through the nozzles 16, thereby avoiding a high pressure loss and more energy consumption of the blower. Thus, by providing the air plenum 18, and selectively opening the same, the rate of heat exchange and resultant dispersal of conditioned air into the space below the chilled beam apparatus 10, is efficiently increased.

Moreover, it will be readily appreciated by one of ordinary skill in the art that the weight 36 may be adjusted anywhere along the length of the adjustment pin 34, thereby enabling rotation of the air damper 20 whenever the air pressure within the air manifold 12 exceeds a predetermined magnitude. In particular, the position of the weight 36 may be adjusted along the length of the adjustment pin 34 in order to selectively increase or decrease the magnitude of the air pressure within the manifold that is required to open the damper 20. For example, moving the weight 36 to a position along the pin 34 spaced from the axle 32 will decrease the threshold pressure (within the manifold 12) necessary to cause the damper 20 to open, while moving the weight closer to the axle 32 along the pin 34 will increase the threshold pressure necessary to open the damper 20. In this manner, the air damper 20 passively occupies a closed position until and unless the air pressure within the air manifold 12 increases to a predetermined amount, dictated by the position of the weight 36, thus causing the air damper 20 to pivot to an open state.

It is envisioned that the chilled beam apparatus 10 of the present invention may be controlled such that when additional air conditioning is demanded from the system, and when the air supply to the air manifold 12 is thereafter increased, that the integrated air damper 20 will open, providing additional ventilation air to the space below the apparatus 10 without the necessity of pushing the air through the nozzles 16. Likewise, when an increased rate of ventilation air is no longer required, and when the air pressure within the air manifold 12 has decreased below a predetermined magnitude, the air damper 20 will again close, returning the chilled beam apparatus to it normal operation.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. An air handling unit, comprising:

a manifold having an inlet configured to receive a supply of air from a blower;

a plurality of induction apertures formed in said manifold, said induction apertures enabling a passage of air from said manifold out of said air handling unit and entering into a space below, and being configured to induce a flow of air from said space below said air handling unit into said air handling unit;

a bypass plenum formed in said manifold and configured to selectively direct additional air from said manifold to said space below said air handling unit without passing through said induction apertures; so that the total amount of the air exiting said air handling unit can be variable;

a damper positioned within said bypass plenum, said damper being pivotable between a closed position and an open position to allow said air from said manifold to exit said air handling unit and enter said space below through said bypass plenum when a pressure within said manifold exceeds a threshold pressure; and an actuator operatively connected to said damper, said actuator being adjustable to set said threshold pressure.

2. The air handling unit of claim 1, wherein:

said actuator includes an axle connected to said damper, a pin mounted to a distal end of said axle opposite said damper and extending generally transverse to said axle, and a weight slidably received on said pin.

3. The air handling unit of claim 2, wherein:

said weight is selectively movable along said pin between a first position in which said weight is adjacent to said axle, and a second position in which said weight is spaced from said axle, to adjust said threshold pressure.

4. The air handling unit of claim 3, wherein:

said actuator includes a structure configured to fix said weight in position on said pin.

* * * * *